US006080070A

United States Patent [19]

Whitley

[11] Patent Number: 6,080,070

[45] Date of Patent: Jun. 27, 2000

[54] PUTTER HEAD WITH IMPROVED ALIGNMENT AND STABILITY FEATURES

[75] Inventor: Tim A. Whitley, Dallas, Tex.

[73] Assignee: Traxx Golf Company, Inc., Granbury, Tex.

[21] Appl. No.: 09/236,480

[22] Filed: Jan. 25, 1999

[51] Int. Cl.[7] ..... A63B 53/04

[52] U.S. Cl. ..... 473/340; 473/328; 473/345

[58] Field of Search ..... 473/324, 328, 473/340, 345, 350

[56] References Cited

U.S. PATENT DOCUMENTS

D. 291,464 8/1987 Whitley .

5,286,027 2/1994 Koumarianos ..... 473/328

5,597,364 1/1997 Thompson ..... 473/328 X 5,749,791 5/1998 Passeri ..... 473/350 X

*Primary Examiner*—John A. Ricci

*Attorney, Agent, or Firm*—Whitham, Curtis & Whitham

[57] ABSTRACT

A putter head includes an aperture through which two rails extending across a bottom of the putter head can be viewed. After establishing a target line, the player first levels the rails flat on the putting surface. Then, the player looks down on the putter head and adjusts his position and aligns the putter head in such a manner that a groove on top of the putter is seen as situated/centered between the rails. A slot running parallel to the putting face of the putter head also is used to ensure that the putter head is in proper alignment. Also, the rails are substantially flat to impart additional horizontal stability and alignment to the putter head during putting.

6 Claims, 5 Drawing Sheets

PUTTER HEAD WITH IMPROVED ALIGNMENT AND STABILITY FEATURES

BACKGROUND OF THE INVENTION

1. Field of the Invention

The invention generally relates to a putter, and more particularly to a putter head having features which aid a golfer in setting up and executing a putt.

2. Description of the Related Art

In recent years, the popularity of golf has increased, which in turn has led to an increase in the number of novice players entering the sport as well as veteran players wishing to improve their game. In many instances, putting is a troublesome area for these players.

Successful putting requires striking a golf ball in such a way that it will travel along a path that leads to the cup. In order to execute a good putt, a player must properly setup and aim the putter, and then execute a consistent putting stroke. To setup a putt, a player will choose the path along which he or she wishes the ball to be directed. Next, the player positions him or herself in correct relation to the golf ball (usually facing perpendicular to the intended path of the ball). During the execution of a putt, the golf ball is struck to direct the ball, at least initially, along a path perpendicular to the putter face, when the putter face is viewed from above.

Striking the ball when the putter face is misaligned with the intended ball path or when the putter bottom is not level with the putting surface often causes putts to be missed. During setup, a player can best judge whether the face of the putter is in alignment with the intended path if his or her line of sight is directly (vertically) above the putter head and ball. If the putter face is perpendicular to the intended direction of travel of the golf ball the player is assured that a forward stroke of the putter at that orientation will direct the ball in the intended direction.

As mentioned above, consistency of a putter stroke is another very important factor in putting. In many instances, during the forward stroke, the putter head encounters grass or even the putting surface which reduces the forward momentum of the putter. This results in an inconsistent or jerky stroke and ultimately a missed putt.

Several putter types have been conceived in recent years to combat the above mentioned putting problems. U.S. Design Patent 291,464 and U.S. Design Patent Application 29/090,058 disclose two examples, however, both designs have proved to be ineffective.

Design Patent 291,464 and Design application 29/090,058 are directed to putter heads which have an aperture in a cental portion and alignment rails on a bottom thereof. Because the walls defining the aperture are tall and of the same height, only a small amount of light enters the slot, thereby making the rails clearly viewable over at limited range of angles. Furthermore, the rails are rounded and thus do not impart horizontal stability to the putter head when resting on the putting surface.

There is therefore a need for an improved putter head which aids a golfer in setting up and aiming a golf putt and further which helps prevent inconsistent putter strokes due to interference with grass or the like.

SUMMARY OF THE INVENTION

It is an object of the present invention to provide an improved putter head that uses novel features to aid a player in setting up and aim a putt.

It is another object of the present invention to achieve the foregoing object by providing a groove and a pair of rails clearly viewable in low-light conditions and over a wide range of angles on the putter head so that a golfer will know that the head is properly aligned when the groove is oriented in a desired manner relative to the rails.

It is another object of the present invention to provide a putter head having rails which are substantially flat so as to impart horizontal stability to the putter during a putt.

It is another object of the present invention to provide a golf putter head having a structure which prevents grass or other putting surface objects from interfering with the putter head during a putt.

These and other objects of the present invention are achieved by providing a putter head which, when viewed from the top, has a semi-elliptical shaped body with a semi-circular aperture extending through the central portion thereof. A substantially flat putting face is formed on the front portion of the semi-elliptical body and a groove is formed on the top portion of the putting face. Two rails extend substantially perpendicularly from the bottom of the putting face, across the semi-circular aperture and to the bottom portion of the semi-elliptical body opposite the putting face. In addition, a hole is provided on the right side top of the putter head for receiving a shaft and grip.

Advantageously, the present invention overcomes the shortcomings of conventional putter heads by providing a wide viewing aperture and a rear portion on the putter head that is shorter than the putting face, thus allowing more light to illuminate the rails. Also, the rails of the present invention are flat on the bottom to impart horizontal positional stability and alignment to the putter head during a putt. The putter head of the present invention thus gives a golfer a clearer view of the rails during putting than do conventional putter heads and imparts greater stability when contacting a putting surface.

It is well-accepted that one of the requirements of successful putting is that the golfer's eyes must be directly over the ball target line: "I do not believe that it is optically possible for the normal sighted person to attain a correct visual impression of the line of a putt at address unless his eyes are positioned directly above the ball-target line." From the book, Golf My Way, by Jack Nicklaus. The importance of the putting stroke itself has also been recognized as important when executing a successful putt: "On the backswing I keep the putter very low to the ground, almost brushing the turf. Throughout the swing, the putter blade stays square to the hole. I want to emphasize that the blade does stay square to the hole." The present invention achieves all of these objectives in at least the following manner. From the book, The Complete Book of Putting, by Arnold Palmer.

During the initial setup, a player places the putter head on the putting surface behind the ball so that both rails on the bottom of the putter head lie flat and level on the putting surface while the golfer is looking through the aperture. When the rails are in this position, a player is assured that the putter head is lying in a parallel and stable position relative to the ground. Next, the golfer positions himself in such a manner that the groove on top of the putting face is between and preferably centered relative to the two rails from a golfer's line-of-sight perspective. When oriented in this manner, the player is oriented directly over the putter head. As a result, the player is assured that the putting face is perpendicular to the intended travel path of the ball and that his eyes are positioned directly above the ball target fine.

Once the player has correctly oriented the putter head with the putting surface and golf ball, the putt is executed by moving the putter back from the golf ball, while maintaining the orientation of the putter head, and then swinging forward. The putter should contact the golfball at the same location and orientation as the initial putt setup in order to direct the ball along the intended ball path perpendicular to the putting face.

Further, during the forward swing, any grass or other putting surface obstructions that might reduce the momentum of the putter will advantageously be deflected by the rails on the putter head. Further, gaps between and to the sides of the rails allow the grass to pass without imparting any loss of momentum, and if the forward putter stroke is too low, the shape of the rails will reduce any loss of due to contact with the putting surface.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
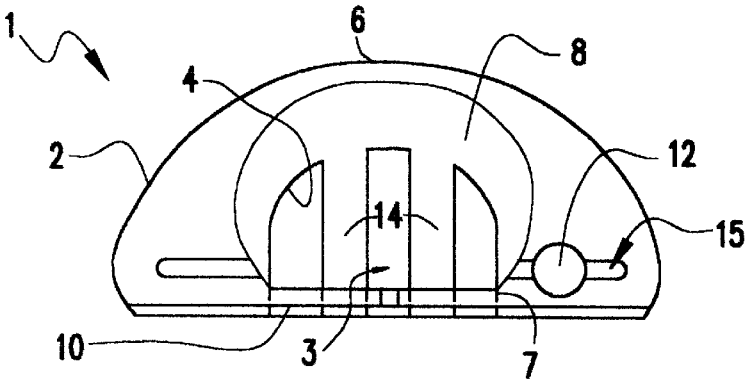
FIG. 1 is a top plan view of preferred embodiment putter head.

Referring now to the drawings, FIG. 1 shows a top view of a preferred embodiment of the putter head 1 of the present invention wherein a putter body 2 has a perimeter preferably with a semi-elliptical shape and a semi-circular aperture 4 extending through a central portion 3. A putting face 10 is formed on a front portion 7 of the putter body 2. A hole 12 is provided in the putter body 2 for receiving a shaft (not shown). Visible through aperture 4 are a pair of rails 14 that extend from a bottom portion 9 of the putting face 10 across aperture 4 and connect to a bottom 11 of the rear portion 6 of the putter body 2. Advantageously, rear portion 6 of the putter body 2 has sides 8 which are rounded to allow even more light to enter the aperture 4. A slot 15 extends along the top of the front portion 7 of the putter body 2, parallel with the putting face 10.

Figure 2:
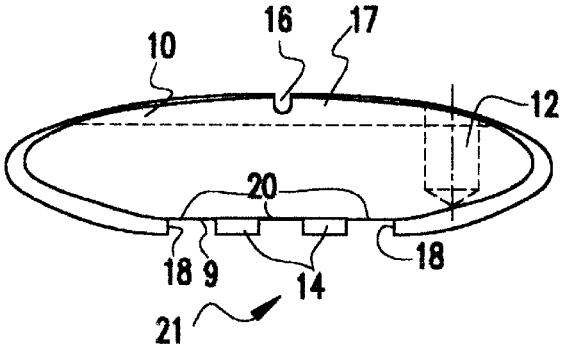
FIG. 2 is a front plan view of the preferred embodiment putter head.

FIG. 2 shows a front view of putter head 1 wherein the putting face 10 has a top portion 17 containing a groove 16. FIG. 2 also shows that rails 14 are spaced apart from each other and from respective adjacent edges 18 of the putter bottom 21 such that three slots 20 are formed. Preferably, slots 20 are of equal width, although those skilled in the art can appreciate that slots 20 may have differing widths if desired.

Figure 3:
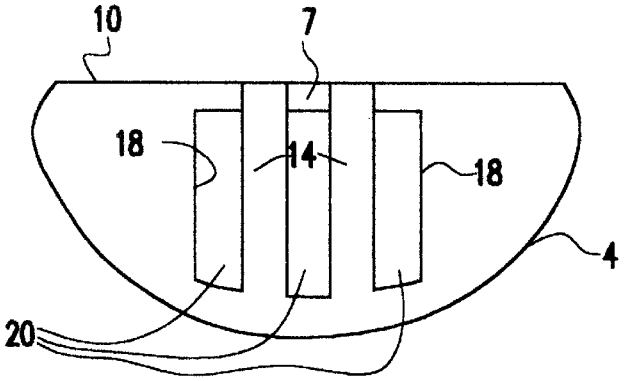
FIG. 3 is a bottom plan view of the preferred embodiment putter head.

FIG. 3 is a bottom view of the putter head showing a horizontal configuration of rails 14 and slots 20.

Figure 4:
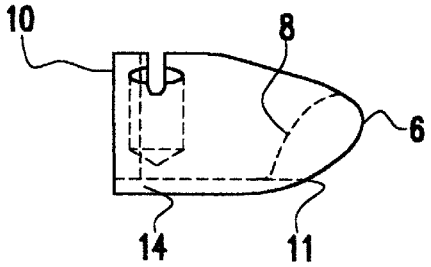
FIG. 4 is a right side plan view of the preferred embodiment putter head.
Figure 5:
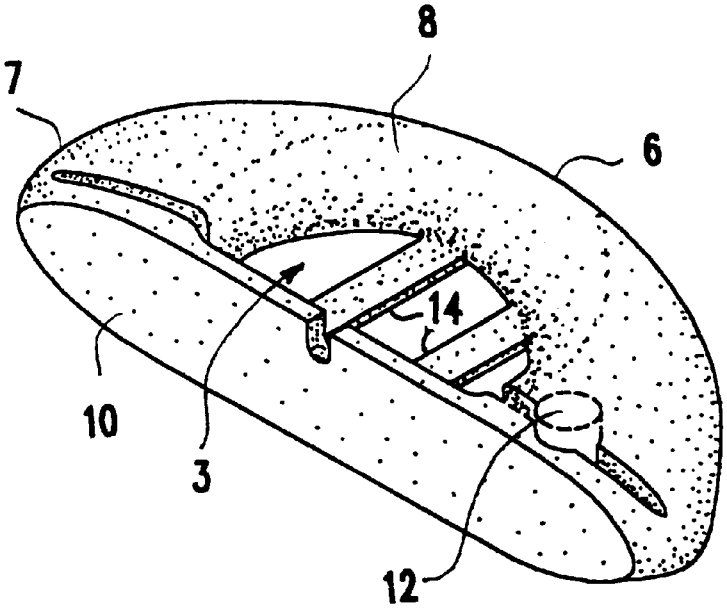
FIG. 5 is an isometric view of the top and front of the preferred embodiment putter head.

FIG. 4 is a side view of putter head 1. A dashed line depicts a contour of the rounded sides 8 of the rear portion 6 of the putter body 2. The rounded sides 8 are also shown in FIG. 5. From FIG. 4 it can be seen that a height of the rear portion 6 of the putter head is smaller than a height of the putting face 10. This arrangement along with rounded sides 8 allows more light to enter the aperture 4, compared with conventional putter head designs, to thereby improve a golfer's view of the rails 14 during putting.

Figure 6:
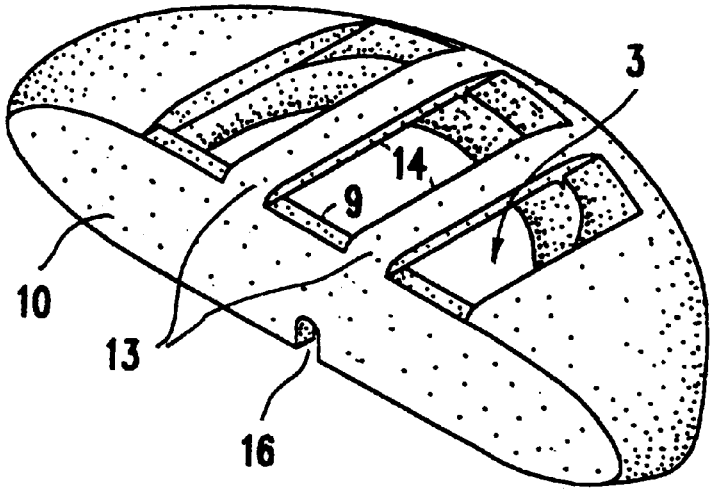
FIG. 6 is an isometric view of the bottom and front of the preferred embodiment putter head.

FIG. 6 is an isometric view of the putter head bottom and front. The rounded fronts 13 of the rails 14 are shown along with slots 20. The rounded fronts 13 of the rails 14 advantageously serve to deflect grass during the forward swing of the putter as well as to prevent the putter from digging into the ground should the forward swing be too low. In addition to the rails 14 deflecting grass, the slots 20 allow grass to pass therethrough freely, thereby reducing drag on the putter since there is less interaction with the grass.

Figure 7A:
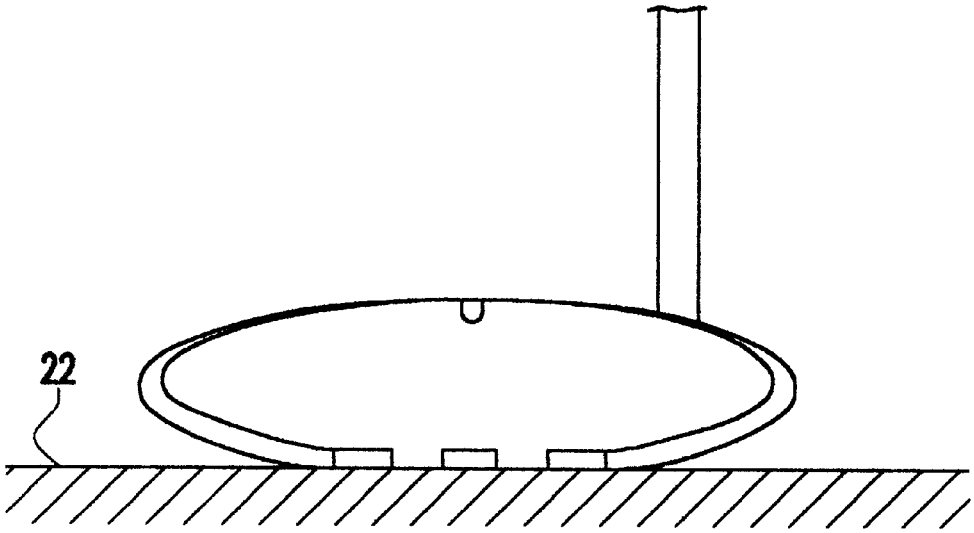
FIGS. 7A–B are front view of the putter head illustrating different orientations of the putter head with respect to the putting surface.
Figure 7B:
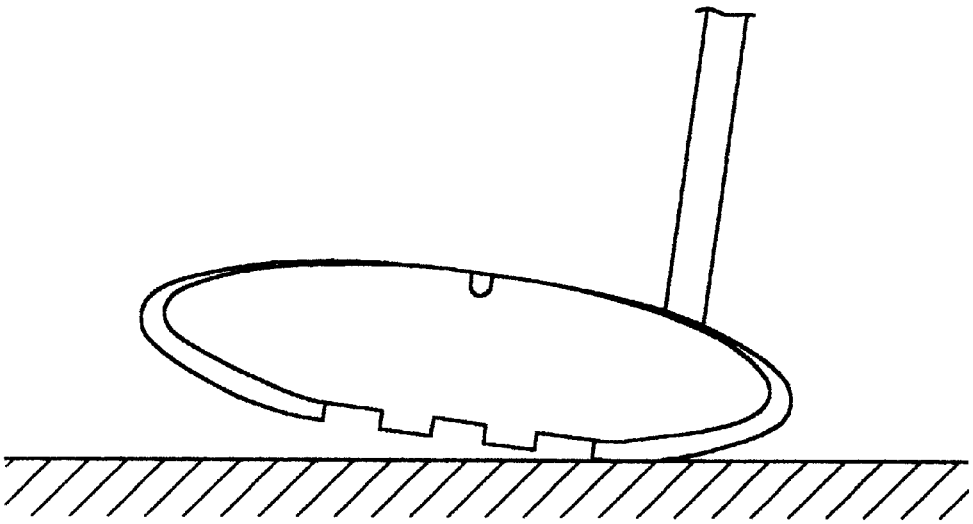

FIG. 7A shows a front view of the putter head where both rails 14 on the bottom of the putter head are touching a putting surface 22, thus indicating that the putter head is level with the putting surface 22. A player standing directly over the putter head can view the rails through the aperture, as shown in FIG. 1, to determine that the putter is level (e.g. horizontally aligned) by making both rails 14 touch the putting surface 22. FIG. 7B shows the putter head when both rails are not touching the putting surface 22, thus as shown, the putter head is not level.

Figure 8B:
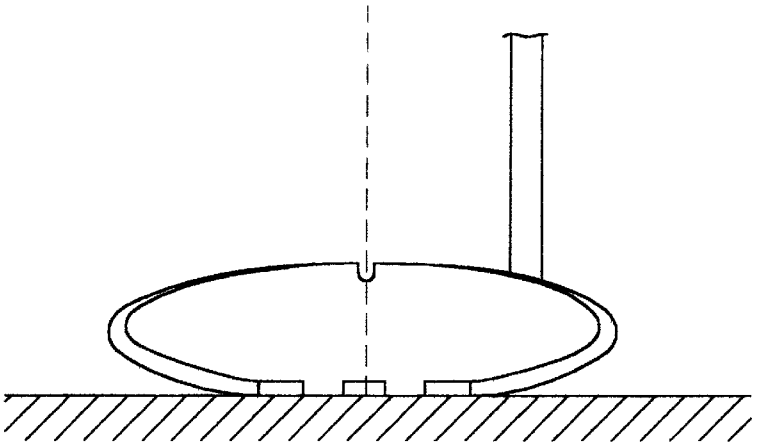
FIG. 8B is a front view of the putter head showing the correct line of sight.
Figure 9B:
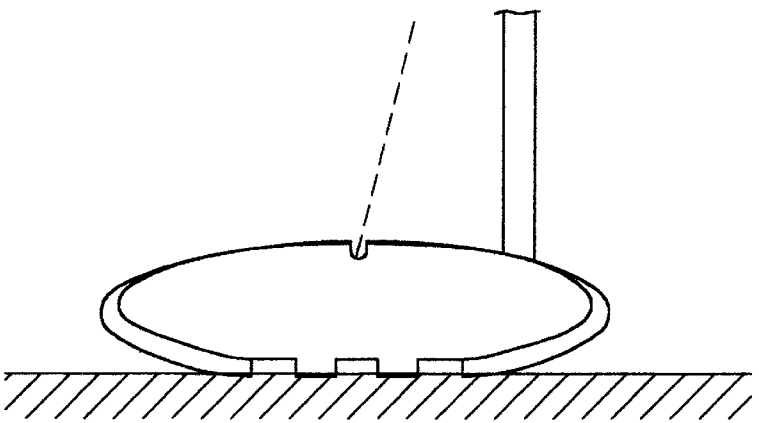
FIG. 9B is a front view of the putter head showing an incorrect line of sight.
Figure 8A:
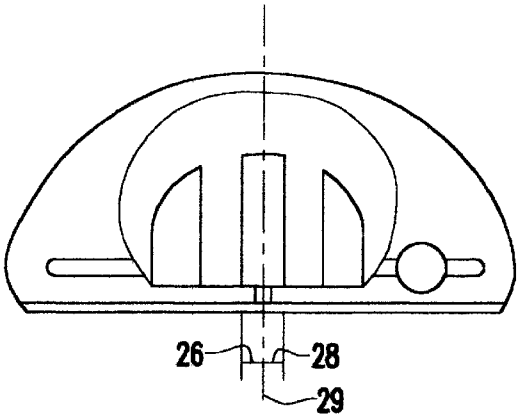
FIG. 8A is a top view of the putter head showing the correct aiming view.
Figure 9A:
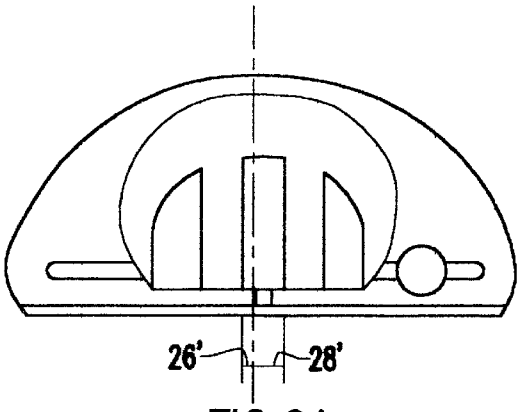
FIG. 9A is a top view of the putter head showing an incorrect aiming view.

FIG. 8A shows the top of the putter head as viewed along a golfer's line of sight 24 shown in FIG. 8B. The line of sight 24 is perpendicular to a plane containing the two rails 14 which, for example, may be the putting surface 22. That the line of sight is perpendicular to the plane containing the two rails is understood from the view in FIG. 8A. To properly align the putter head to the ball, a golfer adjusts his position so that the groove 16 on the putting face 10 appears to be centered between the two rails 14, thereby making distances 26 and 28 between the inner edges of the rails and the centerline 29 of groove 16 equal. When the groove 16 is centered between the two rails 14, a golfer can be assured that his or her line of sight 24 can only be perpendicular to the plane containing the two rails and therefore the putter head is in proper alignment. However, if the distances are unequal, as shown in FIG. 9A by 26' and 28', then the golfer's line of sight would be that shown by reference number 30 in FIG. 9B.

Therefore, when the putter head is viewed from the top, rails 14 and the groove 16 can be used to ensure that a player's line of sight is directly above the putter head (FIG. 9B) by having the player adjust his or her line of sight until the groove 16 appears to be centered between the two rails 14.

Figure 10:
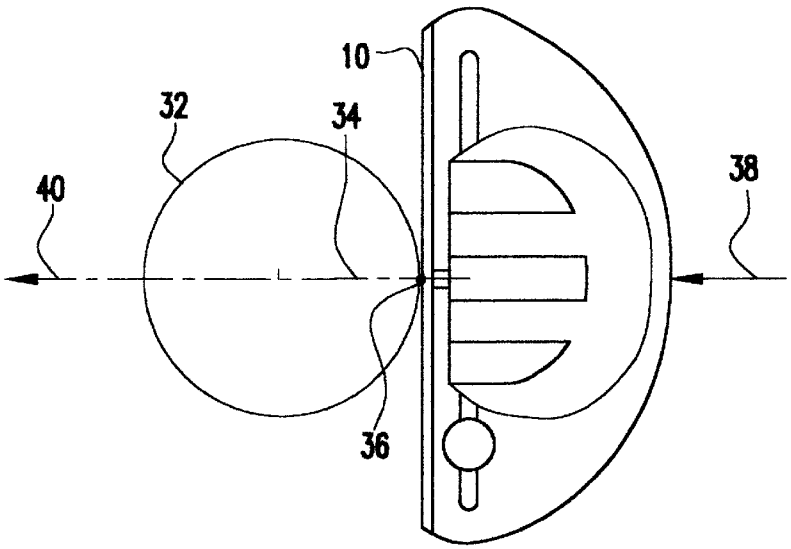
FIG. 10 shows a putter head and golf ball as viewed by a player directly over the putter and ball.

FIG. 10 shows a putter head 1 and golf ball 32 as viewed by a player directly over the putter. When the player's line of sight is vertically over the ball and putter head, the player can more accurately judge if the putting face 10 is perpendicular to and thus in proper alignment with the intended path of travel 40. The stroke path of the putter head 1 is shown by arrow 38 and the combined projected stroke path and line of travel of the ball 32 is shown by arrow 40. It can be seen that when the putting face 10 strikes the ball 32 at point 36 the ball will be directed along path 40 because the putting face 10 is perpendicularly aligned with the travel path 40. This example of a golf putt can only be accomplished if the putter head is in proper alignment relative to the ball before the putt is executed, by setting groove 16 between rails 14 in the aforementioned manner, this objective can be consistently accomplished.

Figure 11:
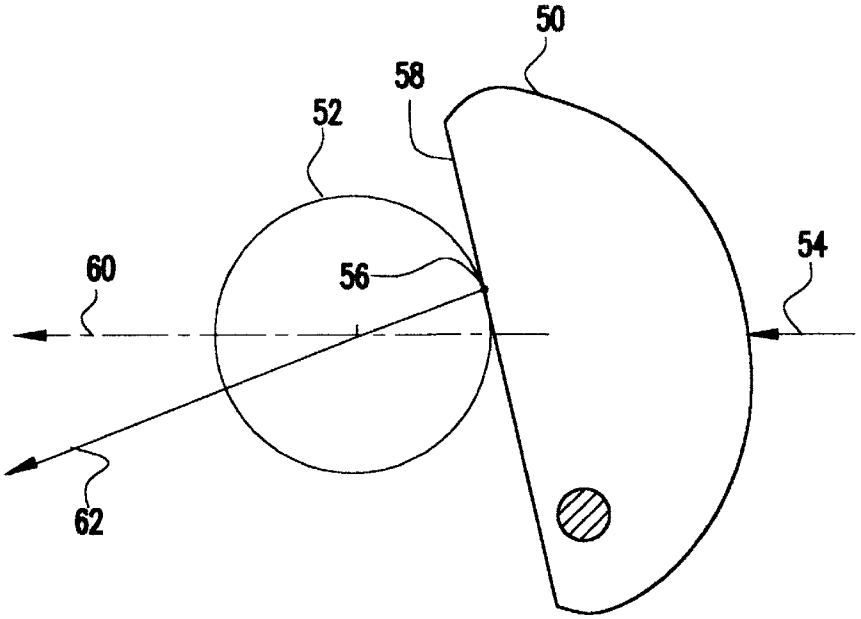
FIG. 11 is a top view of a conventional mallet style putter head as it contacts a golf ball.

FIG. 11, for example, shows a top view of a conventional mallet style putter head 50 and golf ball 52. The putter head 50 is directed along a stroke path 54 and contacts the ball 52 at point 56. Conventional putter heads of this type, at best, include a notch or some similar mark on a top portion of the putter face to assist in alignment of the putter. They, however, are not equipped with rails of the present invention. Consequently, it is often the case that the putting face 58 is not perpendicular to the intended line of travel 60 of the golf ball 52, and as a result the golf ball 52 is directed along the aberrant path shown by arrow 62. To strike the ball so that it will travel along the intended path, it is imperative that the putter face be perpendicular to the intended line of travel. Therefore, to achieve this perpendicularity it is necessary that a players view be directly over the putter head and ball so that the player can accurately judge if the putting face is perpendicular to the intended line of travel of the golf ball. The present invention ensures proper alignment of the putter face to the ball by placing groove 16 between rails 14.

The present invention also represents a significant improvement over conventional putters in a number of other aspects. For example, the aforementioned height difference between the rear portion 6 of the putter body and putter face permits light to be cast into the putter body aperture 4 when sun is at angles other than directly overhead. As a result, the relationship between the rails of the putter head and groove will be more easily visible by a golfer at all times of the day.

Further, unlike other putter heads which have rounded rails, e.g. U.S. Design Patent 291,464, the rails of the present invention are substantially flat, thereby imparting increased horizontal stability and alignment to the head before and during the shot.

Still further, slot 15 provides an additional aid to alignment. For example, when properly aligned, neither vertical wall of slot 15 can be seen. Slot 15 may therefore advantageously be used to check that the groove 16 is between rails 14 and that therefore the putter head is in proper alignment.

While the invention has been described in terms of its preferred embodiments. Those of skill in the art will recognize that the invention can be practiced with modification within the spirit and scope of the appended claims.

We claim:

1. A putter head for a golf putter comprising:

a body having a front portion, a rear portion, and a central portion, said rear portion having a top and a bottom;

a putting face formed on said front portion of said body, said putting face having a top, a bottom, a front, and a back;

an aperture extending through said central portion of said body; and a pair of rails extending perpendicularly from said bottom of said putting face across said aperture and intersecting said bottom of said rear portion of said body;

wherein a height of said putting face is greater than a height of said rear portion of said body.

2. The putter head of claim 1, further comprising:

a groove formed on said top of said putting face, said groove being formed so that said groove is located at a center position between said pair of rails when said putter head is in an aligned position.

3. The putter head of claim 2, wherein said front portion of said body has a slot extending substantially parallel to said putting face, said slot having vertical walls which are not visible to a player when said groove is at said center position between said pair of rails.

4. The putter head of claim 1, wherein said rails are connected to said body so as to define at least one opening through which a putting surface is visible, said opening allowing a player to view said pair of rails when said pair of rails are parallel and in contact with said putting surface.

5. The putter head of claim 1, wherein said body has a semi-elliptical shape.

6. The putter head of claim 1, wherein said aperture is semi-circular in shape so as to allow light to illuminate said pair of rails over a wide range of angles.

* * * * *